US012241150B1

(12) United States Patent
Hua et al.

(10) Patent No.: US 12,241,150 B1
(45) Date of Patent: Mar. 4, 2025

(54) ALUMINUM ALLOY PRE-STRENGTHENING AND HOT FORMING PRODUCTION LINE

(71) Applicant: Wuhan University of Technology, Wuhan (CN)

(72) Inventors: Lin Hua, Wuhan (CN); Zhili Hu, Wuhan (CN); Changhai Niu, Wuhan (CN)

(73) Assignee: Wuhan University of Technology, Wuhan (CN)

( * ) Notice: Subject to any disclaimer, the term of this patent is extended or adjusted under 35 U.S.C. 154(b) by 0 days.

(21) Appl. No.: 18/759,138

(22) Filed: Jun. 28, 2024

(30) Foreign Application Priority Data

Aug. 25, 2023 (CN) ..... 202311096030.2

(51) Int. Cl.
*C22F 1/04* (2006.01)
*B21D 28/24* (2006.01)

(52) U.S. Cl.
CPC ..... *C22F 1/04* (2013.01); *B21D 28/24* (2013.01)

(58) Field of Classification Search
CPC ..... C22F 1/04; B21D 28/24
See application file for complete search history.

(56) References Cited

U.S. PATENT DOCUMENTS

2012/0073347 A1* 3/2012 Luckey ..... B21D 37/16 72/364
2018/0023173 A1* 1/2018 Nuno ..... B21D 22/022 148/691
2019/0368021 A1* 12/2019 Ilinich ..... C22F 1/053

FOREIGN PATENT DOCUMENTS

CN 112496218 A * 3/2021 ..... B21J 1/06
CN 113976789 A * 1/2022
JP 2011240411 A * 12/2011

OTHER PUBLICATIONS

Yang, Yongbiao, et al. "Processing maps for hot deformation of the extruded 7075 aluminum alloy bar: Anisotropy of hot workability." Materials Science and Engineering: A 615 (2014): 183-190. (Year: 2014).*

* cited by examiner

*Primary Examiner* — Keith D. Hendricks
*Assistant Examiner* — Moriah S. Smoot
(74) *Attorney, Agent, or Firm* — Aasheesh V. Shravah; CM LAW

(57) ABSTRACT

An aluminum alloy pre-strengthening and hot forming production line is provided, including a pre-strengthening heat treatment mechanism, a forging mechanism, and a trim press. The pre-strengthening heat treatment mechanism includes a roll forging machine, a solid solution furnace, a quenching water tank, an aging furnace, and a heat preservation furnace. The forging mechanism includes an upsetting press machine, and a forging press machine. The upsetting press machine is configured for blanking an heat preserved aluminum alloy bar-shaped blank, and the forging press machine is configured for forging and forming the blanked aluminum alloy bar-shaped blank. The trim press is configured for trimming the forged and formed aluminum alloy rod-shaped blank, so as to obtain an aluminum alloy member meeting a requirement.

1 Claim, 3 Drawing Sheets

ALUMINUM ALLOY PRE-STRENGTHENING AND HOT FORMING PRODUCTION LINE

CROSS-REFERENCE TO RELATED APPLICATION

This patent application claims the benefit and priority of Chinese Patent Application No. 2023110960302 filed with the China National Intellectual Property Administration on Aug. 25, 2023, the disclosure of which is incorporated by reference herein in its entirety as part of the present application.

TECHNICAL FIELD

The present disclosure relates to the technical field of aluminum alloy forming, and in particular to an aluminum alloy pre-strengthening hot and forming production line.

BACKGROUND

Aluminum alloy is a type of light alloy, among which 7xxx series aluminum alloy has high specific strength, low cost, and good corrosion resistance, and is an ideal material for aviation, transportation and machinery industries. Aluminum alloy forging process is a method for producing forgings with certain shape, size, and mechanical properties by applying pressure to metal blanks by forging machinery to make the metal blanks plastically deform. Forging not only can eliminate as-cast defects and improve microstructure, but also can maintain the integrity of metal streamline. Therefore, the mechanical properties of forgings are generally better than those of castings made of the same material.

Hot deformation process of aluminum alloy involves a variety of microstructure mechanisms, and changes in deformation temperature and strain rate will cause corresponding changes in the internal structure of the material. Firstly, the hot deformation can be divided into two microstructure mechanisms: work hardening and dynamic softening. In order to ensure the service performance of the alloy after forming, subsequent artificial aging steps are usually required to improve the strength of the alloy. In a traditional hot forming process, a blank is usually subjected to solid solution treatment, then the temperature is lowered to a set temperature for forming, after the forming is completed, the blank is quenched, and finally the strength of the blank is improved by aging treatment. On this basis, Lin Jianguo, a professor from Imperial College, UK, first put forward Solution Heat Treatment, Forming, and Cold-die Quenching (HFQ). In this process, cold die hot forming and hot blank quenching are used. In the HFQ process, heat treatment and hot forming are integrated into one operation, a higher strain is achieved, meanwhile, post-forming performance is guaranteed.

As the traditional hot forming process involves numerous procedures, and the parts are heated unevenly during quenching, it is easy to cause hot deformation, and the forming accuracy is affected. The microstructure of the parts formed by HFQ process is unstable, so artificial aging or pre-aging treatment must be carried out immediately. Meanwhile, the material should be subjected to solid solution treatment before forming, and has to go through a long period of artificial aging to reach the target strength, which is not in harmony with the production rhythm of vehicle body parts.

SUMMARY

In view of this, a purpose of the present disclosure is to provide an aluminum alloy pre-strengthening and hot forming production line to solve the technical problems that the traditional aluminum alloy die forging process has a long production cycle, and large energy consumption due to multiple times of heating.

In order to achieve the purpose above, the present disclosure provides an aluminum alloy pre-strengthening and hot forming production line, including a pre-strengthening heat treatment mechanism, a forging mechanism, and a trim press.

The pre-strengthening heat treatment mechanism includes a roll forging machine, a solid solution furnace, a quenching water tank, an aging furnace, and a heat preservation furnace. The roll forging machine is configured for roll forging an aluminum alloy bar-shaped blank, the solid solution furnace is configured for solid solution treating a roll forged aluminum alloy bar-shaped blank, the quenching water tank is configured for quenching a solid solution treated aluminum alloy bar-shaped blank, the aging furnace is configured for aging a quenched aluminum alloy bar-shaped blank, and the heat preservation furnace is configured for heat preserving of an aged aluminum alloy bar-shaped blank.

The forging mechanism includes an upsetting press machine, and a forging press machine. The upsetting press machine is configured for blanking a heat preserved aluminum alloy bar-shaped blank, and the forging press machine is configured for forging and forming a blanked aluminum alloy bar-shaped blank.

The trim press is configured for trimming a forged and formed aluminum alloy rod-shaped blank, so as to obtain an aluminum alloy member meeting requirements.

In some embodiments, the pre-strengthening heat treatment mechanism further includes a first manipulator, a second manipulator, and a third manipulator. The first manipulator is arranged between the roll forging machine and the solid solution furnace, and configured for transferring the roll forged aluminum alloy bar-shaped blank into the solid solution furnace. The second manipulator is arranged between the solid solution furnace and the aging furnace, and configured for transferring the solid solution treated aluminum alloy bar-shaped blank into the aging furnace. The third manipulator is arranged between the aging furnace and the heat preservation furnace, and configured for transferring the aged aluminum alloy bar-shaped blank into the heat preservation furnace.

In some embodiments, the forging mechanism further includes a fourth manipulator, a fifth manipulator, and a sixth manipulator. The fourth manipulator is arranged between the heat preservation furnace and the upsetting press machine, and configured for transferring the heat preserved aluminum alloy bar-shaped blank into the upsetting press machine. The fifth manipulator is arranged between the upsetting press machine and the forging press machine, and configured for transferring the blanked aluminum alloy bar-shaped blank into the forging press machine for forging and forming. The sixth manipulator is arranged between the forging press machine and the trim press, and configured for transferring the forged and formed aluminum alloy bar-shaped blank into the trim press.

In some embodiments, the forging mechanism further includes a first spraying robot. The first spraying robot is arranged relative to the upsetting press machine, and configured for spraying a first release agent into the upsetting press machine.

In some embodiments, the forging mechanism further includes a second spraying robot. The second spraying robot is arranged relative to the forging press machine, and configured for spraying a second release agent into the forging press machine.

In some embodiments, the aluminum alloy pre-strengthening and hot forming production line further includes a detection mechanism. The detection mechanism includes a weighing platform, a detection box, a rotating assembly, a camera, a temperature detector, and a seventh manipulator. The detection box is fixed at a weighing end of the weighing platform. The rotating assembly includes a first roller, a second roller, and two rotating driving parts. The first roller and the second roller are parallel to each other and both rotatably arranged in the detection box, the formed aluminum alloy member is placed between the first roller and the second roller, the two rotating driving parts are respectively connected to the first roller and the second roller, and configured for driving the first roller and the second roller to rotate, respectively. The camera is arranged above the first roller and the second roller and configured for photographing the aluminum alloy member between the first roller and the second roller. The temperature detector is configured for detecting temperature of the aluminum alloy member. The seventh manipulator is arranged between the trim press and the weighing platform, and configured for transferring a trimmed aluminum alloy member into the detection box.

In some embodiments, the detection mechanism further includes a first fixing block, and a second fixing block. The first fixing block is fixed within the detection box, and the first roller is rotatably arranged on the first fixing block. The second fixing block is mounted within the detection box, and the second roller is rotatably arranged on the second fixing block.

In some embodiments, the second fixing block is slidably arranged within the detection box. The detection mechanism further includes a distance adjusting cylinder, a cylinder body of the distance adjusting cylinder is fixed within the detection box, and an output shaft of the distance adjusting cylinder is fixedly connected to the second fixing block.

In some embodiments, the detection mechanism further includes a transparent cover plate, and the transparent cover plate is configured for covering the detection box.

In some embodiments, the detection mechanism further includes an open-close cylinder, an output shaft of the open-close cylinder is connected to the transparent cover plate, and configured for driving the transparent cover plate to translate.

Compared with the prior art, the technical solutions provided by the present disclosure achieve the beneficial effects that a technical route including heat preservation treatment before forging, deformation by forging, and trimming is used. The heating is reduced from three times in the prior art to one time, such that the machining time of the aluminum alloy is significantly shortened, and the production cycle and the production cost are significantly reduced on the premise of fully meeting the product performance requirements.

Figure 1:
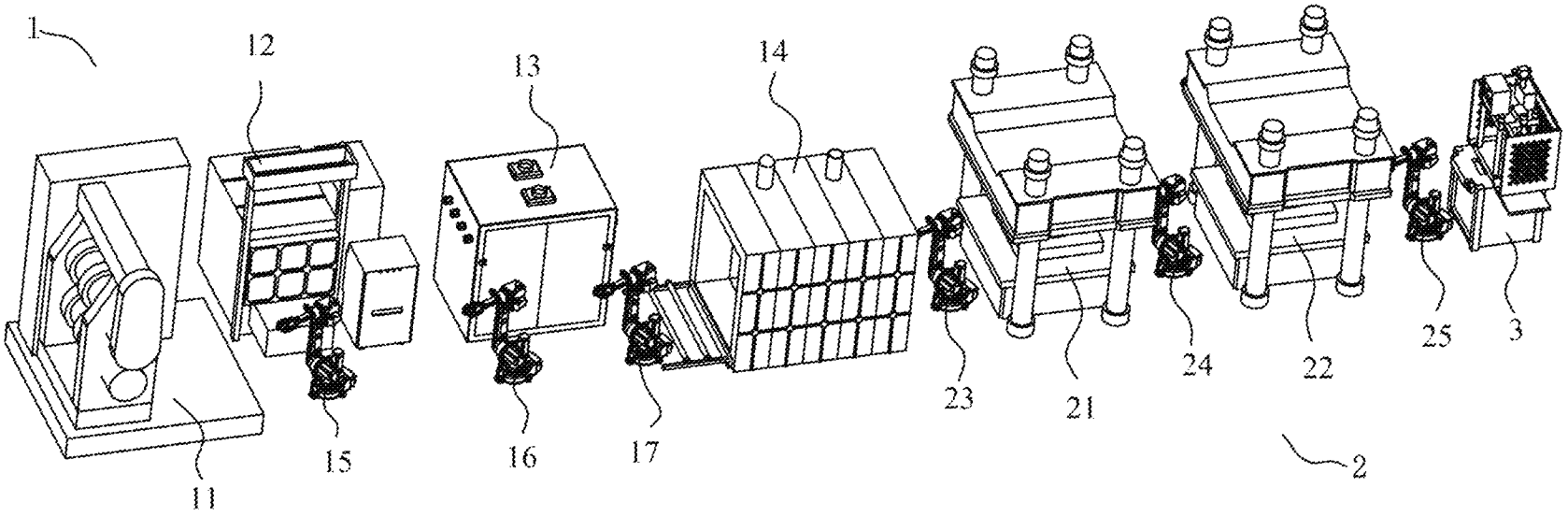
FIG. 1 is a schematic diagram of a three-dimensional structure of an embodiment of an aluminum alloy pre-strengthening and hot forming production line according to the present disclosure.

In the drawings: 1 strengthening heat treatment mechanism; 11 roll forging machine; 12 solid solution furnace; 13 aging furnace; 14 heat preservation furnace; 15 first manipulator; 16 second manipulator; 17 third manipulator; 2 forging mechanism; 21 upsetting press machine; 22 forging press machine; 23 fourth manipulator; 24 fifth manipulator; 25 sixth manipulator; 26 first spraying robot; 27 second spraying robot; 3 trim press; 4 detection mechanism; 41 weighing platform; 42 detection box; 43 rotating assembly; 431 first roller; 432 second roller; 433 first fixing block; 434 second fixing block; 44 camera; 45 temperature detector; 46 transparent cover plate; 47 open-close cylinder; 5 aluminum alloy member.

DETAILED DESCRIPTION OF THE EMBODIMENTS

The preferred embodiments of the present disclosure are specifically described below with reference to the accompanying drawings. The accompany drawings constitute a part of the present disclosure, are used to illustrate the principle of the present disclosure together with embodiments of the present disclosure, and are not intended to limit the scope of the present disclosure.

Figure 2:
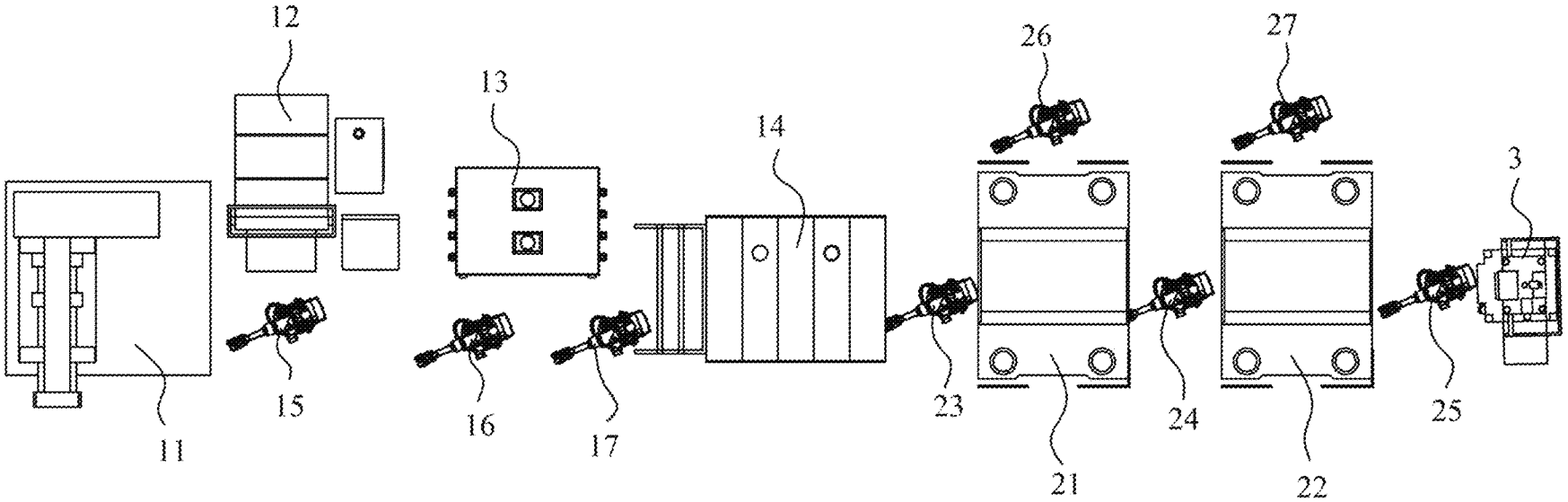
FIG. 2 is a top view of an aluminum alloy pre-strengthening and hot forming production line in FIG. 1.

Please referring to FIG. 1 and FIG. 2, an aluminum alloy pre-strengthening and hot forming production line provided by the present disclosure includes a pre-strengthening heat treatment mechanism 1, a forging mechanism 2, and a trim press 3.

The pre-strengthening heat treatment mechanism 1 includes a roll forging machine 11, a solid solution furnace 12, a quenching water tank, an aging furnace 13, and a heat preservation furnace 14. The roll forging machine 11 is configured for roll forging an aluminum alloy bar-shaped blank, the solid solution furnace 12 is configured for solid solution treating a roll forged aluminum alloy bar-shaped blank, the quenching water tank is configured for quenching quenching a solid solution treated aluminum alloy bar-shaped blank, the aging furnace 13 is configured for aging a quenched aluminum alloy bar-shaped blank, and the heat preservation furnace 14 is configured for heat preservation an aged aluminum alloy bar-shaped blank. The roll forging machine 11 can be replaced according to different forming process requirements. That is, according to different forming processes used, corresponding blanking devices can be installed to meet different forming process requirements.

The forging mechanism 2 includes an upsetting press machine 21, and a forging press machine 22. The upsetting press machine 21 is configured for blanking a heat preserved aluminum alloy bar-shaped blank, and the forging press machine 22 is configured for forging and forming a blanked aluminum alloy bar-shaped blank.

The trim press 3 is configured for trimming a forged and formed aluminum alloy rod-shaped blank, so as to obtain an aluminum alloy member meeting requirements.

During use, the aluminum alloy bar-shaped blank is fed into the roll forging machine 11 which is configured for roll forging the aluminum alloy bar-shaped blank. Then, the roll forged aluminum alloy bar-shaped blank is transferred into the solid solution furnace 12 for solid solution treatment. After that, the solid solution treated aluminum alloy bar-shaped blank is transferred into the quenching water tank filled with cooling water for quenching treatment. Then the quenched aluminum alloy bar-shaped blank is transferred into the aging furnace 13 for aging. The aged aluminum alloy bar-shaped blank is transferred into the heat preservation furnace 14 for heat preservation. The heat preserved aluminum alloy bar-shaped blank is then transferred into the upsetting press machine 21 for blanking. The blanked aluminum alloy bar-shaped blank is then transferred into the forging press machine 22 for forging and forming. And finally, the forged and formed aluminum alloy bar-shaped blank is transferred to the trim press 3 for trimming, thus obtaining the aluminum alloy member meeting the requirements.

According to the aluminum alloy pre-strengthening and hot forming production line provided by the present disclosure, a technical route including heat preservation treatment before forging, deformation by forging, and trimming is used. The heating is reduced from three times in the prior art to one time, such that the machining time of the aluminum alloy is significantly shortened, and the production cycle and the production cost are significantly reduced on the premise of fully meeting the product performance requirements.

In order to achieve the transfer of the aluminum alloy bar-shaped blank conveniently, please referring to FIG. 1 and FIG. 2, in a preferred embodiment, the pre-strengthening heat treatment mechanism 1 further includes a first manipulator 15, a second manipulator 16, and a third manipulator 17. The first manipulator 15 is arranged between the roll forging machine 11 and the solid solution furnace 12, and configured for transferring the roll forged aluminum alloy bar-shaped blank into the solid solution furnace 12. The second manipulator 16 is arranged between the solid solution furnace 12 and the aging furnace 13, and configured for transferring the solid solution treated aluminum alloy bar-shaped blank into the aging furnace 13. The third manipulator 17 is arranged between the aging furnace 13 and the heat preservation furnace 14, and configured for transferring the aged aluminum alloy bar-shaped blank into the heat preservation furnace 14. By providing the first manipulator 15, the second manipulator 16 and the third manipulator 17, the transfer efficiency of the aluminum alloy bar-shaped blank can be improved.

In order to achieve the transfer of the aluminum alloy bar-shaped blank conveniently, please referring to FIG. 1 and FIG. 2, in a preferred embodiment, the forging mechanism 2 further includes a fourth manipulator 23, a fifth manipulator 24, and a sixth manipulator 25. The fourth manipulator 23 is arranged between the heat preservation furnace 14 and the upsetting press machine 21, and configured for transferring the heat preserved aluminum alloy bar-shaped blank into the upsetting press machine 21. The fifth manipulator 24 is arranged between the upsetting press machine 21 and the forging press machine 22, and configured for transferring the blanked aluminum alloy bar-shaped blank into the forging press machine 22 for forging and forming. The sixth manipulator 25 is arranged between the forging press machine 22 and the trim press 3, and configured for transferring the forged and formed aluminum alloy bar-shaped blank into the trim press 3.

In order to facilitate the demolding of the aluminum alloy bar-shaped blank in the upsetting press machine 21, please referring to FIG. 1 and FIG. 2, in a preferred embodiment, the forging mechanism 2 further includes a first spraying robot 26. The first spraying robot 26 is arranged relative to the upsetting press machine 21, and configured for spraying a first release agent into the upsetting press machine 21. Prior to transferring the aluminum alloy bar-shaped blank into the upsetting press machine 21, the first release agent needs to be sprayed into the upsetting press machine 21 by the first spraying robot 26, thus facilitating the subsequent demolding of the aluminum alloy bar-shaped blank.

In order to facilitate the demolding of the aluminum alloy bar-shaped blank in the forging press machine 22, please referring to FIG. 1 and FIG. 2, in a preferred embodiment, the forging mechanism 2 further includes a second spraying robot 27. The second spraying robot is arranged relative to the forging press machine 22, and used to spray a second release agent into the forging press machine 22. Prior to transferring the aluminum alloy bar-shaped blank into the forging press machine 22, the second release agent needs to be sprayed into the forging press machine 22 by the second spraying robot 27, thus facilitating the subsequent demolding of the aluminum alloy bar-shaped blank. It should be understood that the first release agent and the second release agent may be the same type of release agent, or different types of release agent, which is not limited in the present disclosure.

Figure 3:
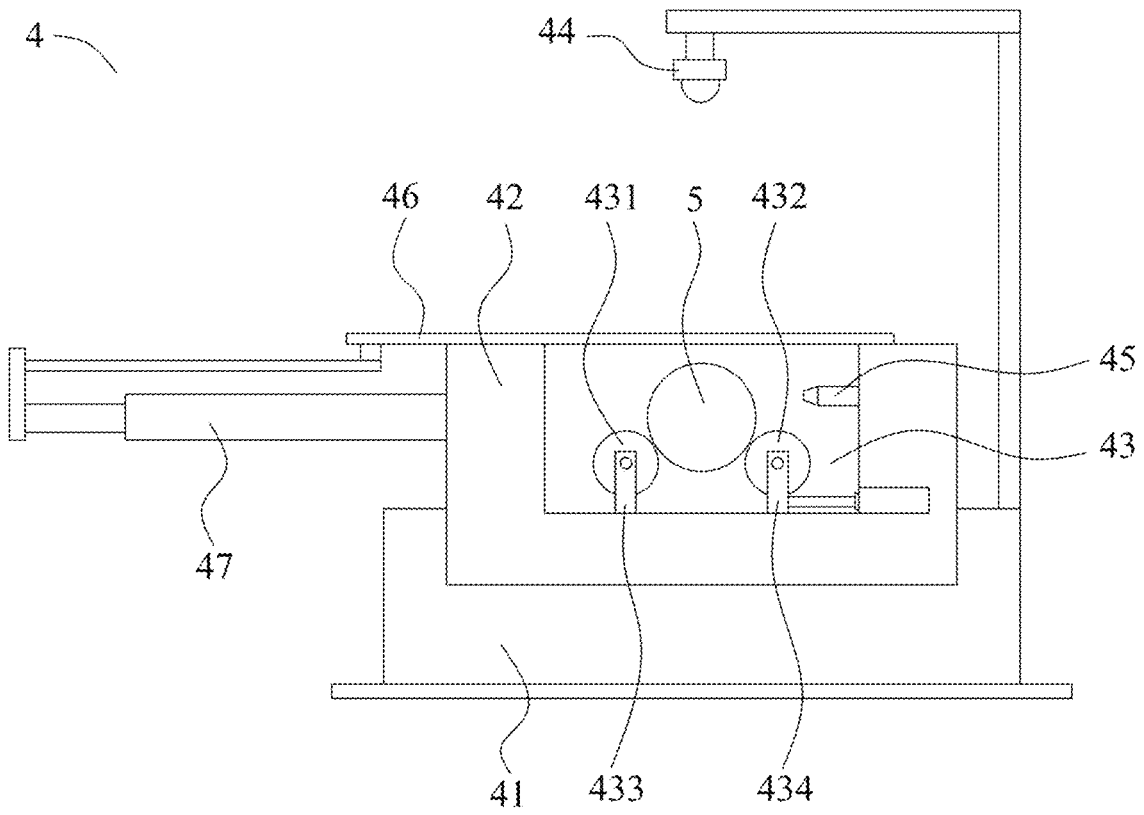
FIG. 3 is a structural schematic diagram of a detection mechanism of an embodiment of an aluminum alloy pre-strengthening and hot forming production line according to the present disclosure.

In order to conveniently detect whether the formed aluminum alloy member is qualified or not, please referring to FIG. 2 and FIG. 3, in a preferred embodiment, the aluminum pre-strengthening hot forming production line further includes a detection mechanism 4. The detection mechanism 4 includes a weighing platform 41, a detection box 42, a rotating assembly 43, a camera 44, a temperature detector 45, and a seventh manipulator. The detection box 42 is fixed to a weighing end of the weighing platform 41. The rotating assembly 43 includes a first roller 431, a second roller 432, and two rotating driving parts, the first roller 431 and the second roller 432 are parallel to each other and both rotatably arranged in the detection box 42. The formed aluminum alloy member 5 is placed between the first roller 431 and the second roller 432, and the two rotating driving parts are respectively connected to the first roller 431 and the second roller 432, and configured for driving the first roller 431 and the second roller 432 to rotate, respectively. The camera 44 is arranged above the first roller 431 and the second roller 432, and configured for photographing the aluminum alloy member between the first roller 431 and the second roller 432. The temperature detector 45 is configured for detecting temperature of the aluminum alloy member 5. The seventh manipulator is arranged between the trim press 3 and the weighing platform 41, and configured for transferring a trimmed aluminum alloy member into the detection box 42. During use, the trimmed aluminum alloy member is transferred by the seventh manipulator into the detection box 42 and placed between the first roller 431 and the second roller 432. And then the first roller 431 and the second roller 432 are driven by the rotating driving parts to rotate synchronously, thus driving the aluminum alloy member 5 to rotate. During the rotating process of the aluminum alloy member 5, an image of a surface of the aluminum alloy member 5 is photographed by the camera 44, so as to detect whether there are cracks and other defects on the surface of the aluminum alloy member 5. Meanwhile, the temperature of the aluminum alloy member 5 is detected using the temperature detector 45, thus detecting whether the temperature meets the standard and is uniform or not. Afterwards, the aluminum alloy member 5 is transferred to different collecting boxes according to the detection result, thus screening out unqualified products.

In order to achieve rotatable connections between the first roller 431 as well as the second roller 432 and the detection box 42 specifically, please referring to FIG. 3, in a preferred embodiment, the detection mechanism 4 further includes a first fixing block 433, and a second fixing block 434. The first fixing block 433 is fixed within the detection box 42, and the first roller 431 is rotatably arranged on the first fixing block 433. The second fixing block 434 is mounted within the detection box 42, and the second roller 432 is rotatably arranged on the second fixing block 434.

In order to detect the aluminum alloy members 5 with different diameters conveniently, please referring to FIG. 3, in a preferred embodiment, the second fixing block 434 is slidably arranged within the detection box 42. The detection mechanism 4 further includes a distance adjusting cylinder 45, a cylinder body of the distance adjusting cylinder 46 is fixed within the detection box 42, and an output shaft of the distance adjusting cylinder 46 is fixedly connected to the second fixing block 434. During use, the second fixing block 434 is driven by the distance adjusting cylinder 46 to move relative to the first fixing block 433, thus adjusting the distance between the second fixing block 434 and the first fixing block 433 to adapt to the detection of the aluminum alloy members 5 with different diameters.

In order to prevent a situation that the accuracy of the detection result is reduced due to rapid temperature drop of the aluminum alloy member 5, please referring to FIG. 3, in a preferred embodiment, the detection mechanism 4 further includes a transparent cover plate 46, which is configured for covering the detection box 42, such that the heat preservation can be achieved without affecting the normal use of the camera 44.

In order to control the open or close of the transparent cover plate 46 conveniently, please referring to FIG. 3, in a preferred embodiment, the detection mechanism 4 further includes an open-close cylinder 47, and an output shaft of the open-close cylinder 47 is connected to the transparent cover plate 46, and configured for driving the transparent cover plate 46 to translate.

In order to understand the present disclosure better, an operation process of the aluminum alloy pre-strengthening and hot forming production line provided by the present disclosure is described in detail below in conjunction with FIG. 1 to FIG. 3. During use, the aluminum alloy bar-shaped blank is fed into the roll forging machine 11 which is configured for carrying out roll forging on the aluminum alloy bar-shaped blank. Then, the roll forged aluminum alloy bar-shaped blank is transferred into the solid solution furnace 12 for solution treatment. After that, the solid solution treated aluminum alloy bar-shaped blank is transferred into the quenching water tank filled with cooling water for quenching treatment. The quenched aluminum alloy bar-shaped blank is transferred into the aging furnace 13 for aging. The aged aluminum alloy bar-shaped blank is then transferred into the heat preservation furnace 14 for heat preserving. The heat preserved aluminum alloy bar-shaped blank is transferred into the upsetting press machine 21 for blanking. Then, the blanked aluminum alloy bar-shaped blank is transferred to the forging press machine 22 for forging and forming. And finally, the forged and formed aluminum alloy bar-shaped blank is transferred to a trim press 3 for trimming, thus obtaining the aluminum alloy member meeting the requirement.

According to the aluminum alloy pre-strengthening and hot forming production line provided by the present disclosure, a technical route including heat preservation treatment before forging, deformation of forging and trimming is used. The heating is reduced from three times in the prior art to one time, such that the machining time of the aluminum alloy is significantly shortened, and the production cycle and the production cost are significantly reduced on the premise of fully meeting the product performance requirements.

A detection mechanism 4 for the aluminum alloy member is further provided by the present disclosure, which can screen out unqualified aluminum alloy members according to the image and temperature information of the surface of the aluminum alloy members, thus improving the qualification rate of the product.

It should be understood that the layout of the production line can be arranged in a linear arrangement as shown in FIG. 1 and FIG. 2, or in an annular arrangement to save space, which is not limited by the present disclosure.

The foregoing is only the preferred embodiments of the present disclosure, but the scope of protection of the present disclosure is not limited thereto. Any changes or substitutions that can be easily thought of by those skilled in the art within the technical scope disclosed by the present disclosure should fall within the scope of protection of the present disclosure.

What is claimed is:

1. An aluminum alloy pre-strengthening and hot forming production line, comprising a pre-strengthening heat treatment mechanism, a forging mechanism, and a trim press, wherein the pre-strengthening heat treatment mechanism comprises a roll forging machine, a solid solution furnace, a quenching water tank, an aging furnace, and a heat preservation furnace; the roll forging machine is configured for roll forging an aluminum alloy bar-shaped blank, the solid solution furnace is configured for solid solution treating a roll forged aluminum alloy bar-shaped blank, the quenching water tank is configured for quenching a solid solution treated aluminum alloy bar-shaped blank, the aging furnace is configured for aging a quenched aluminum alloy bar-shaped blank, and the heat preservation furnace is configured for heat preserving of an aged aluminum alloy bar-shaped blank;

the pre-strengthening heat treatment mechanism further comprises a first manipulator, a second manipulator, and a third manipulator; the first manipulator is arranged between the roll forging machine and the solid solution furnace, and configured for transferring the roll forged aluminum alloy bar-shaped blank into the solid solution furnace; the second manipulator is arranged between the solid solution furnace and the aging furnace, and configured for transferring the solid solution treated aluminum alloy bar-shaped blank into the aging furnace; and the third manipulator is arranged between the aging furnace and the heat preservation furnace, and configured for transferring the aged aluminum alloy bar-shaped blank into the heat preservation furnace;

the forging mechanism comprises an upsetting press machine, and a forging press machine; the upsetting press machine is configured for blanking a heat preserved aluminum alloy bar-shaped blank, and the forging press machine is configured for forging and forming a blanked aluminum alloy bar-shaped blank;

the forging mechanism further comprises a fourth manipulator, a fifth manipulator, and a sixth manipulator; the fourth manipulator is arranged between the heat preservation furnace and the upsetting press machine, and configured for transferring the heat preserved aluminum alloy bar-shaped blank into the upsetting press machine; the fifth manipulator is arranged between the upsetting press machine and the forging press machine, and configured for transferring the blanked aluminum alloy bar-shaped blank into the forging press machine for forging and forming; and the sixth manipulator is arranged between the forging press machine and the trim press, and configured for transferring a forged and formed aluminum alloy bar-shaped blank into the trim press;

the forging mechanism further comprises a first spraying robot, and the first spraying robot is arranged relative to the upsetting press machine, and configured for spraying a first release agent into the upsetting press machine;

the forging mechanism further comprises a second spraying robot, and the second spraying robot is arranged relative to the forging press machine, and configured for spraying a second release agent into the forging press machine; and the trim press is configured for trimming the forged and formed aluminum alloy bar-shaped blank, so as to obtain an aluminum alloy member;

the aluminum alloy pre-strengthening and hot forming production line further comprises a detection mechanism, the detection mechanism comprises a weighing platform, a box, a rotating assembly, a camera, a temperature detector, and a seventh manipulator; the box is fixed on the weighing platform; the rotating assembly comprises a first roller, a second roller, and two rotating driving parts; the first roller and the second roller are parallel to each other and both arranged in the box; the aluminum alloy member is placed between the first roller and the second roller; the two rotating driving parts are respectively connected to the first roller and the second roller, and configured for respectively driving the first roller and the second roller to rotate synchronously; the camera is arranged above the first roller and the second roller and located outside the box, the camera is configured for photographing the aluminum alloy member between the first roller and the second roller; the temperature detector is arranged inside the box and configured for detecting temperature of the aluminum alloy member; and the seventh manipulator is arranged between the trim press and the weighing platform, and configured for transferring the aluminum alloy member into the box;

the detection mechanism further comprises a first fixing block, and a second fixing block; the first fixing block is fixed within the box, and the first roller is arranged on the first fixing block; and the second fixing block is mounted within the box, and the second roller is arranged on the second fixing block;

the second fixing block is capable of sliding within the box, the detection mechanism further comprises a distance adjusting cylinder, a cylinder body of the distance adjusting cylinder is fixed within the box, and an output shaft of the distance adjusting cylinder is fixedly connected to the second fixing block;

the detection mechanism further comprises a transparent cover plate, and the transparent cover plate is configured for covering the box;

the detection mechanism further comprises an open-close cylinder, an output shaft of the open-close cylinder is connected to the transparent cover plate, and configured for driving the transparent cover plate to translate.

* * * * *